US009502812B2

(12) United States Patent
Akagi et al.

(10) Patent No.: US 9,502,812 B2
(45) Date of Patent: Nov. 22, 2016

(54) CONNECTOR HAVING MOVABLE HOUSING WITHIN FRAME

(71) Applicant: YAZAKI CORPORATION, Minato-ku, Tokyo (JP)

(72) Inventors: Yosuke Akagi, Shizuoka (JP); Nobuyuki Sakamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/920,918

(22) Filed: Oct. 23, 2015

(65) Prior Publication Data

US 2016/0118742 A1 Apr. 28, 2016

(30) Foreign Application Priority Data

Oct. 28, 2014 (JP) ..... 2014-218917

(51) Int. Cl.

| | |
|---|---|
| ***H01R 13/506*** | (2006.01) |
| ***H01R 13/74*** | (2006.01) |
| ***H01R 13/73*** | (2006.01) |
| ***H01R 13/627*** | (2006.01) |
| ***H01R 13/514*** | (2006.01) |
| ***H01R 13/518*** | (2006.01) |

(52) U.S. Cl.

CPC ..... *H01R 13/506* (2013.01); *H01R 13/514* (2013.01); *H01R 13/518* (2013.01); *H01R 13/6273* (2013.01); *H01R 13/73* (2013.01); *H01R 13/74* (2013.01); *H01R 13/741* (2013.01); *H01R 13/743* (2013.01); *H01R 13/745* (2013.01)

(58) Field of Classification Search

CPC .. H01R 13/74; H01R 13/743; H01R 13/518; H01R 13/73; H01R 13/745; H01R 13/6273; H01R 13/741; H01R 13/506

USPC ..... 439/701, 549, 550, 552, 557

See application file for complete search history.

(56) References Cited

U.S. PATENT DOCUMENTS 5,344,347 A * 9/1994 Inoue ..... H01R 13/193 439/701

5,913,703 A * 6/1999 Suzuki ..... H01R 13/518 439/489

FOREIGN PATENT DOCUMENTS

JP H06-111882 A 4/1994

* cited by examiner

*Primary Examiner* — Abdullah Riyami
*Assistant Examiner* — Justin Kratt
(74) *Attorney, Agent, or Firm* — Mots Law, PLLC

(57) ABSTRACT

A connector includes a pair of connector housings, a fitting part provided in one connector housing of the pair of connector housings, and a fitted part provided in another connector housing and to which the fitting part is fitted. The fitted part has a frame and a movable housing. The movable housing is arranged within the frame, and is movable in a fitting direction. Timing to complete fitting between the movable housing and the fitting part is different from timing to complete fitting between the frame and the fitting part. The frame and the movable housing have a locking part which temporarily locks the movable housing within the frame. The locking part is restored by releasing the temporary locking in a state in which the fitting between the fitting part and the movable housing is completed. A periphery of the restored locking part is covered with a protection part.

7 Claims, 11 Drawing Sheets

CONNECTOR HAVING MOVABLE HOUSING WITHIN FRAME

CROSS REFERENCE TO RELATED APPLICATIONS

This application claims the priority of Japanese Patent Application No. 2014-218917, filed on Oct. 28, 2014, the entire content of which are incorporated herein by reference.

BACKGROUND

Technical Field

The present invention relates to a connector.

Related Art

Conventionally, a connector that includes a pair of connector housings, a fitting part provide in one connector housing of the pair of connector housings, and a fitted part provided in another connector housing and to which the fitting part is fitted is known (see JP 6-111882 A).

In this connector, the fitting part of one of the connector housings has an outer housing as a frame to which a fixed terminal holder is provided, and a movable terminal holder as a movable housing which is arranged movably in a fitting direction of the connector housing in the outer housing.

Further, the movable terminal holder is latched temporarily in a state of preceding the fixed terminal holder of the outer housing in the fitting direction of the connector housings. Thus, if the pair of the connector housing are fit with each other, after the movable terminal holder, prior to the fixed terminal holder, completes the fitting with the fitted part of the other connector housing, the fixed terminal holder completes the fitting with the fitted part of the other connector housing.

As described above, by varying the timings to complete the fitting of the outer housing and the movable connector housing, fitting force of the pair of the connector housings can be dispersed, thereby coping with the multipolarization of the terminal and the like that are received in the connector housings.

Incidentally, in the connector as in JP 6-111882 A, in order to temporarily lock a movable housing within a frame, a deflectable locking part locked to the frame is provided in the movable housing. By fitting the pair of connector housings together, this locking part is deflected by an engagement releasing piece provided in the other connector housing and releases the temporary locking of the movable housing.

However, in the connector as in JP 6-111882 A, fitting of the movable housing is completed in a state in which the locking part that has released the temporary locking of the movable housing is deflected. Accordingly, there is a possibility that permanent deformation will occur in the locking part and the movable housing cannot be temporarily locked stably.

On the other hand, in the connector as in JP 6-111882 A, the locking part is greatly exposed from the movable housing in a state in which the locking part is restored, i.e., in a state in which the locking part is free. Accordingly, there is a possibility that damage will occur in the locking part or the like and the movable housing cannot be temporarily locked stably.

SUMMARY

In the light of the above-described problems, an object of this invention is to provide a connector capable of preventing permanent deformation or damage of a locking part and capable of performing temporary locking of a movable housing stably.

A connector according to one aspect of the present invention includes a pair of connector housings, a fitting part provided in one connector housing of the pair of connector housings, and a fitted part provided in another connector housing of the pair of connector housings and to which the fitting part is fitted. The fitted part has a frame and a movable housing. The movable housing is arranged within the frame so as to be movable in a fitting direction of the one connector housing, and timing to complete fitting between the movable housing and the fitting part is different from timing to complete fitting between the frame and the fitting part. A deflectable locking part configured to temporarily lock the movable housing within the frame is provided in at least any one of the frame and the movable housing. The locking part is restored by releasing the temporary locking of the movable housing in a state in which the fitting between the fitting part and the movable housing is completed. A periphery of the restored locking part is covered with a protection part.

In this connector, the locking part is restored by releasing the temporary locking of the movable housing in the state in which the fitting between the fitting part and the movable housing is completed. In other words, fitting of the movable housing is not completed in a state in which the locking part that has released the temporary locking of the movable housing is deflected.

Accordingly, since the locking part is not held in a deflected manner in a state in which the fitting of the movable housing is completed, permanent deformation of the locking part can be prevented.

Further, since the periphery of the restored locking part is covered with the protection part, the locking part is not exposed to outside in a free state. Accordingly, interference with a peripheral member when the locking part is in a free state can be prevented, and damage of the locking part can be prevented.

Therefore, in such a connector, permanent deformation or damage of the locking part can be prevented, and the temporary locking of the movable housing can be performed stably.

The locking part may have a first locking part provided on the movable housing and a second locking part provided in the frame, when the fitting part and the movable housing are fitted together, the first locking part is deflected by abutment on the fitting part, is locked to a first engaged part provided in the frame, and causes the movable housing to be held within the frame, and when the fitting part and the movable housing are fitted together, the second locking part is deflected by abutment on a releasing part provided on the one connector housing and releases the temporary locking of the movable housing.

In this connector, the first locking part holds the movable housing within the frame when fitting part and the movable housing are fitted together, and the second locking part holds the movable housing within the frame before the pair of connector housings is fitted together. Accordingly, the movable housing can be temporarily locked within the frame reliably until the fitting of the movable housing is completed.

A plurality of the movable housings may be arranged in the frame, and timings for the plurality of the movable housings to complete fitting with the fitting parts may be different from each other.

According to this connector, since the timings for the plural movable housings to complete fitting with the fitting parts are different from each other, the fitting force of the pair of the connector housings can be dispersed further, whereby fitting workability of the pair of the connector housings can be enhanced.

One aspect of the present invention has an effect of providing a connector capable of preventing permanent deformation or damage of a locking part and capable of performing temporary locking of a movable housing stably.

DETAILED DESCRIPTION

Figure 1:
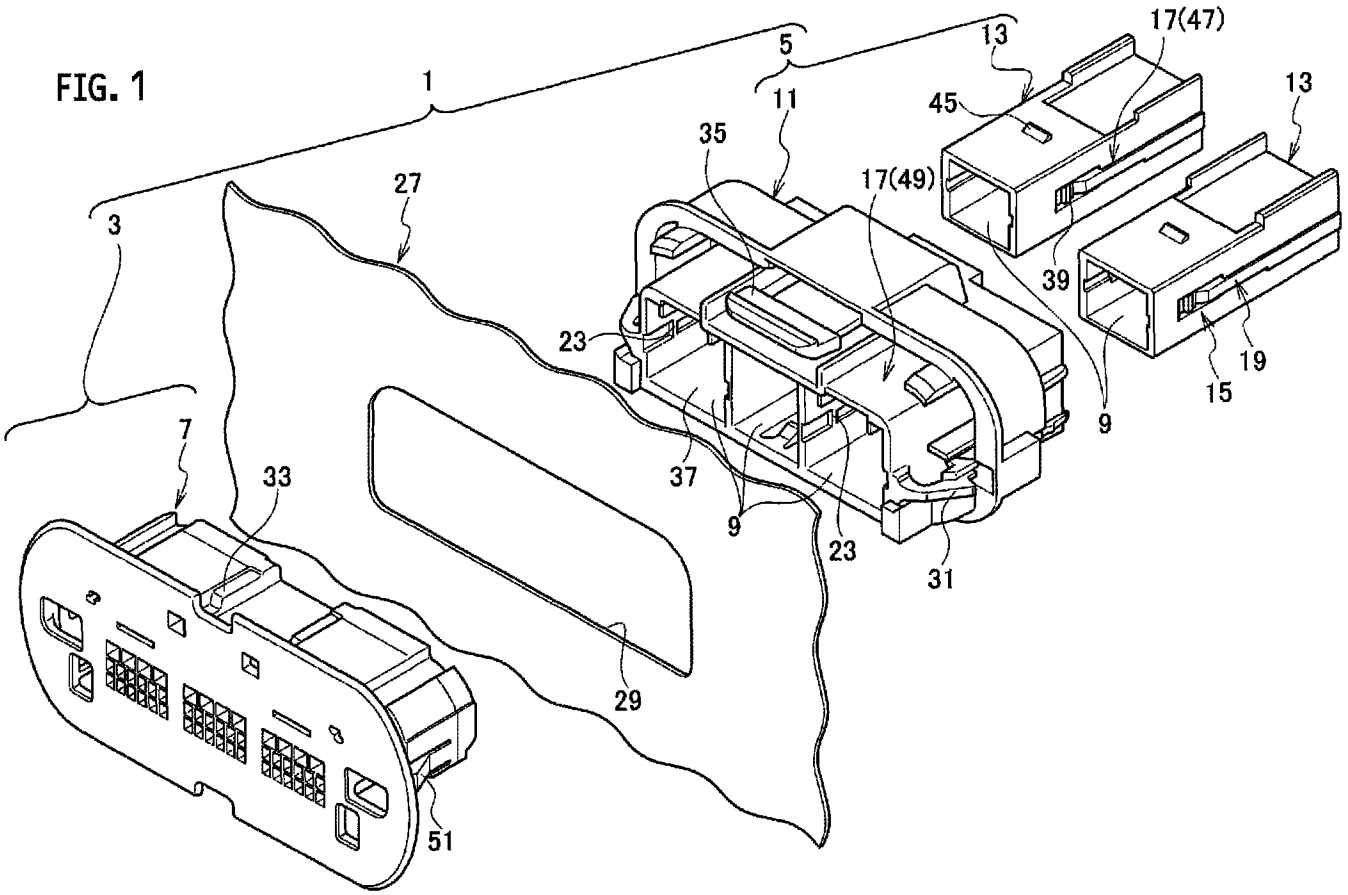
FIG. 1 is an exploded perspective view of a connector according to an embodiment of the present invention.
Figure 2:
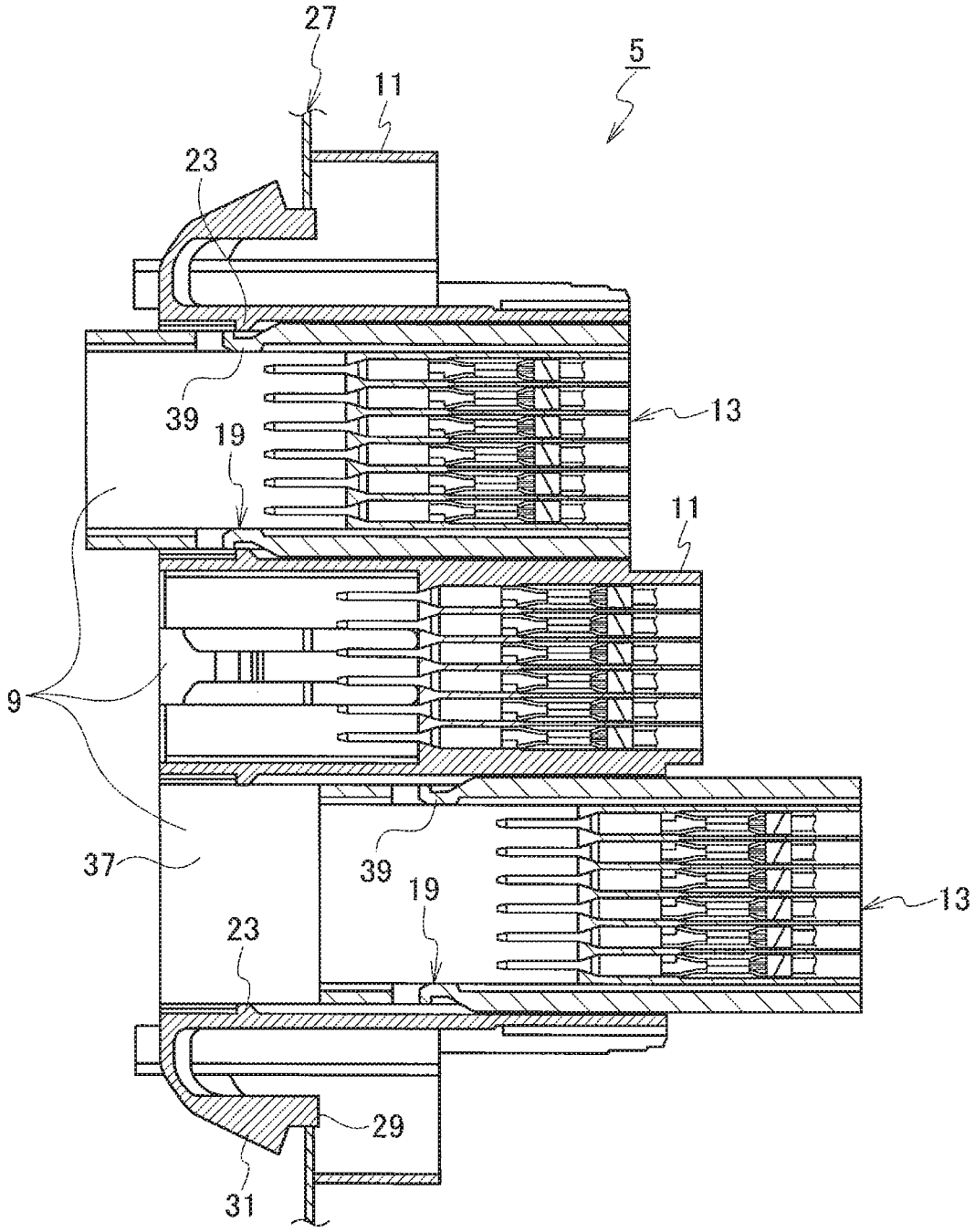
FIG. 2 is a sectional view when a movable housing is assembled to a frame of another connector housing of the connector according to the embodiment of the present invention.
Figure 3:
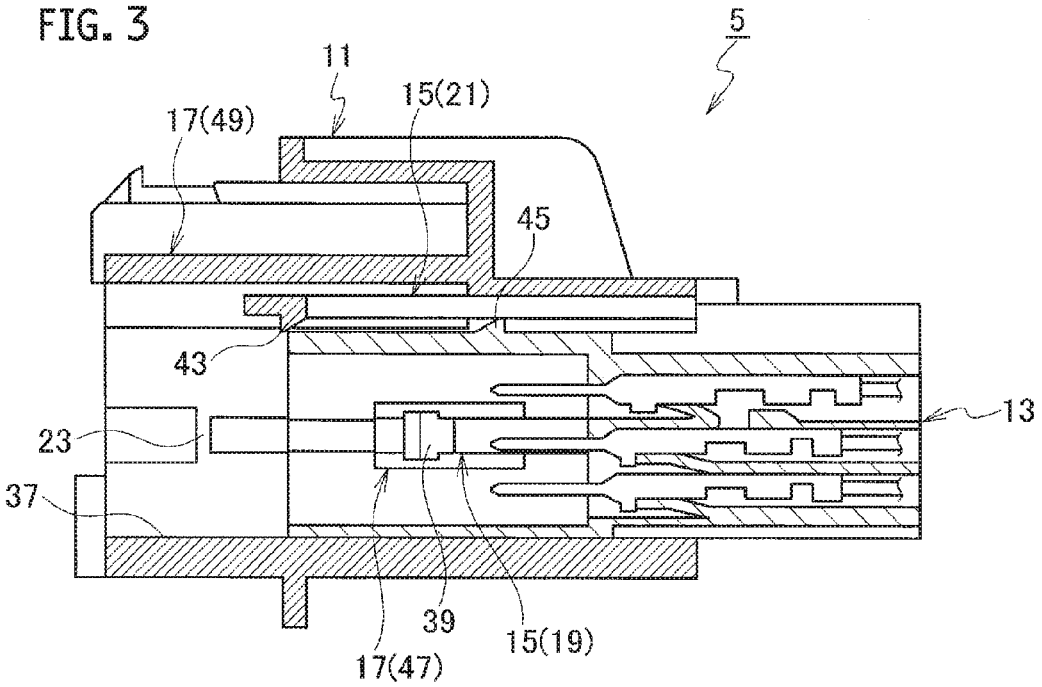
FIG. 3 is a sectional view when the movable housing is assembled to the frame of the other connector housing of the connector according to the embodiment of the present invention.
Figure 4:
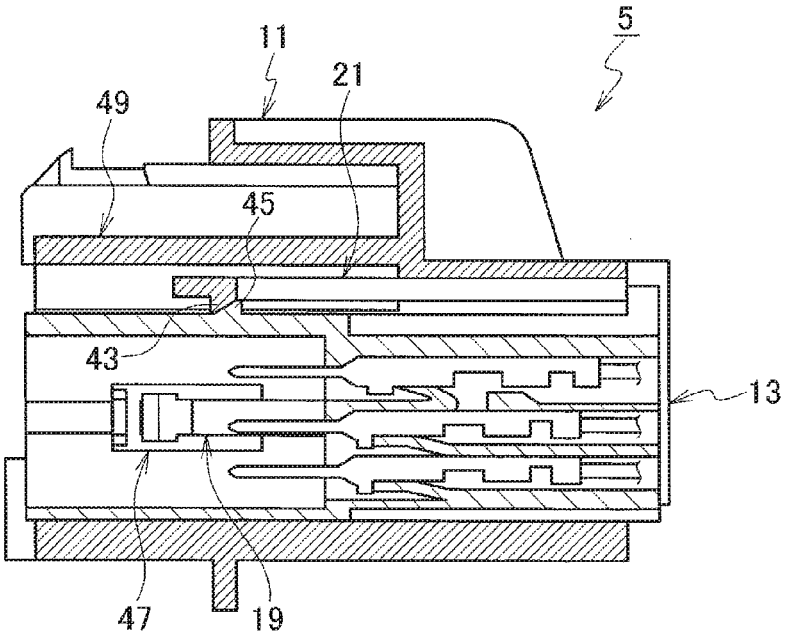
FIG. 4 is a sectional view when the movable housing is assembled to the frame of the other connector housing of the connector according to the embodiment of the present invention.
Figure 5:
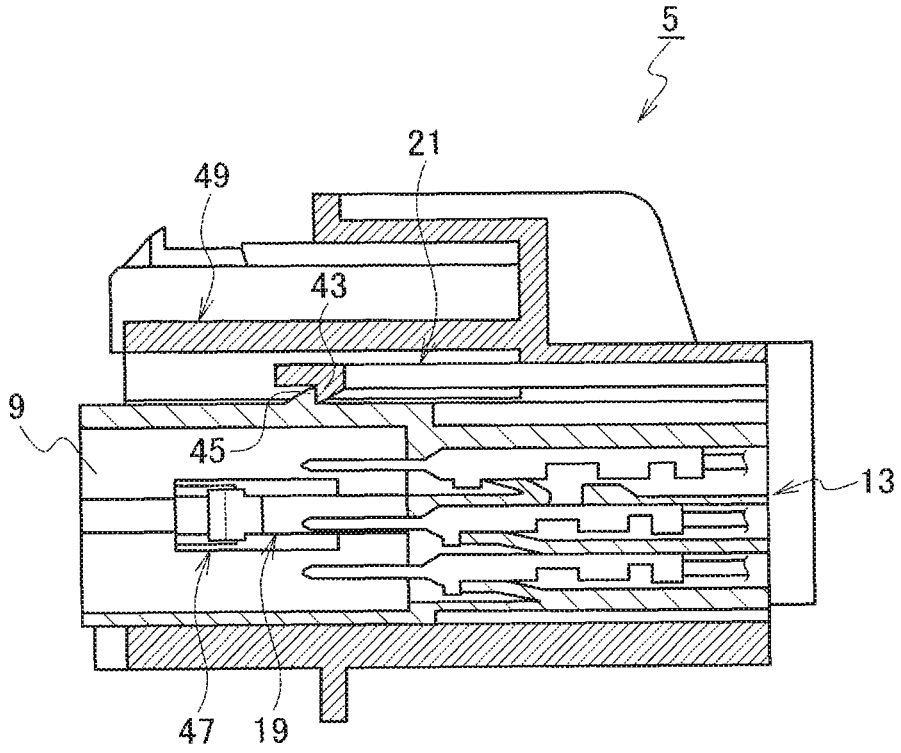
FIG. 5 is a sectional view when the movable housing has been assembled to the frame of the other connector housing of the connector according to the embodiment of the present invention.
Figure 6:
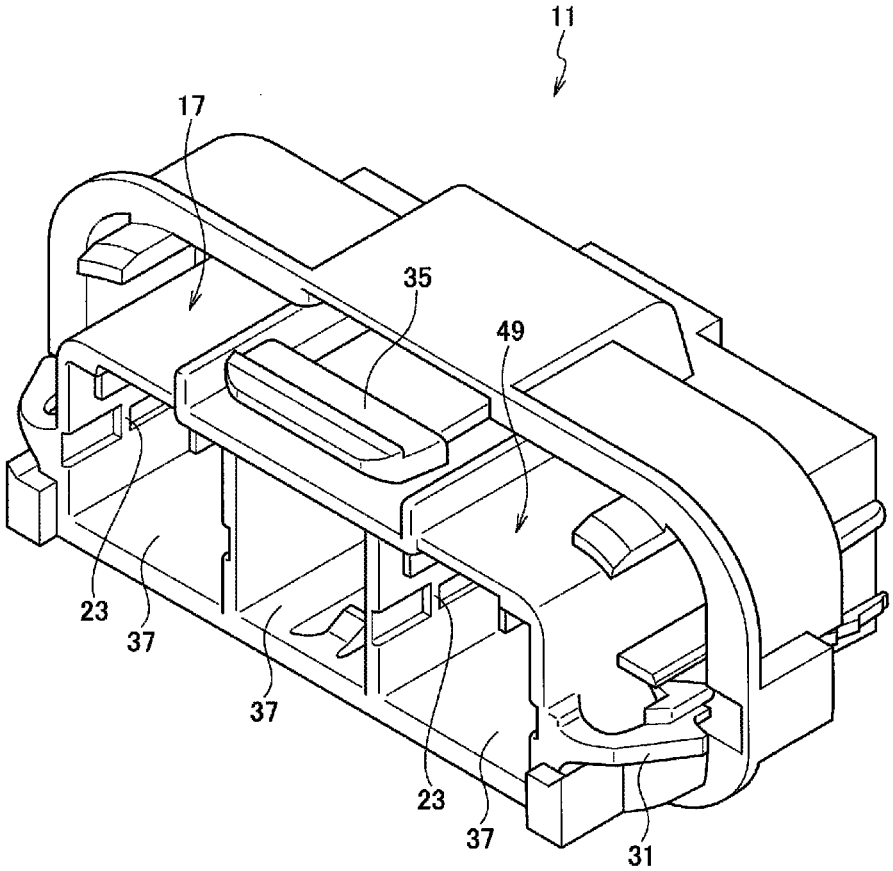
FIG. 6 is a perspective view of the frame of the connector according to the embodiment of the present invention.
Figure 7:
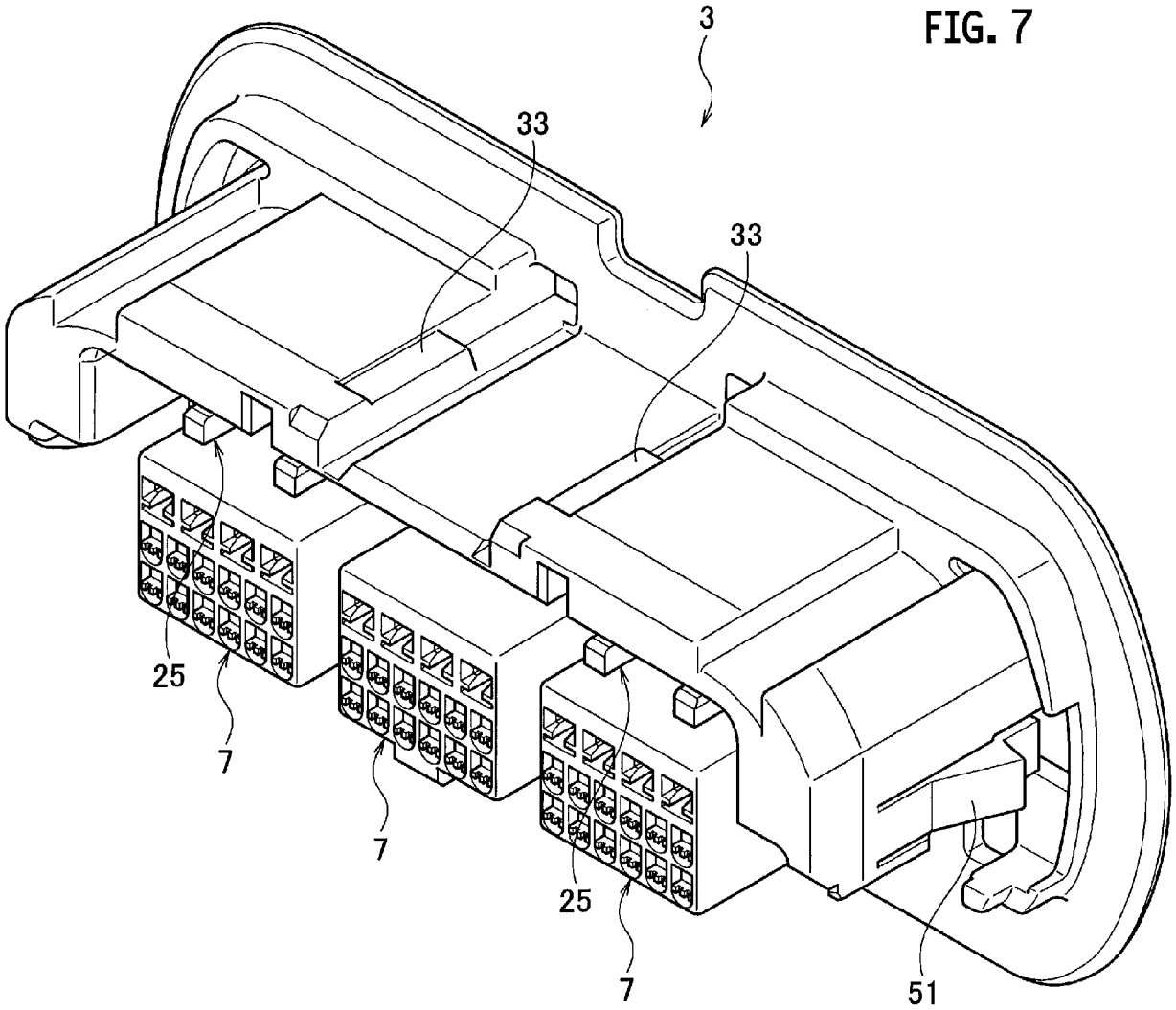
FIG. 7 is a perspective view of one connector housing of the connector according to the embodiment of the present invention.
Figure 8:
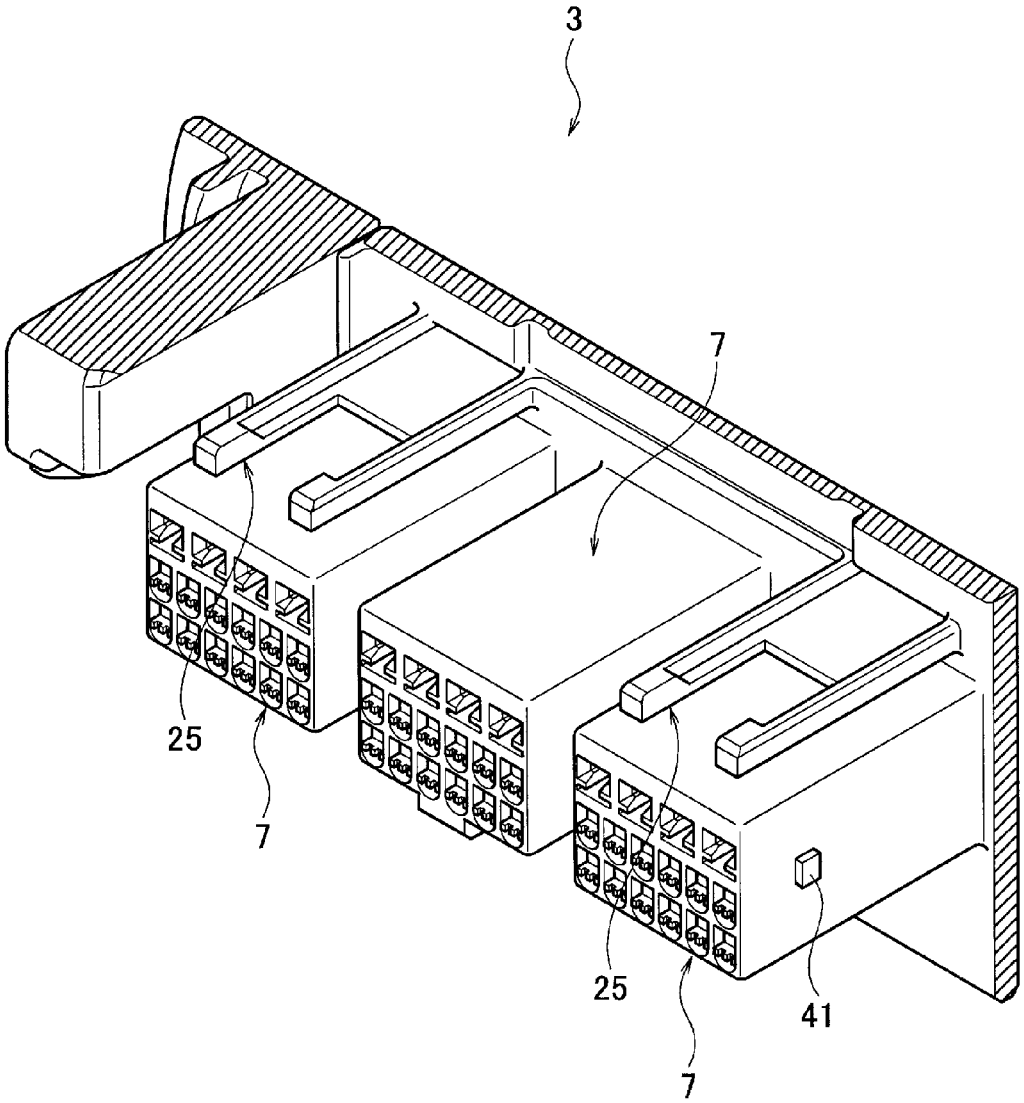
FIG. 8 is a sectional view of a portion of the one connector housing of the connector according to the embodiment of the present invention.

A connector according to an embodiment of the present invention will be described by way of FIGS. 1 to 12.

The connector 1 according to the present embodiment includes a pair of connector housings 3, 5, a fitting part 7 which is provided in the connector housing 3 that is one of this pair of the connector housings 3, 5; and a fitted part 9 which is provided in the other connector housing 5, allows the fitting part 7 to be fit with each other.

Further, the fitted part 9 has: a frame 11; and a movable housing 13 which is arranged movably in a fitting direction with the one connector housing 3 in this frame 11, and whose timing to complete fitting with the fitting part 7 is different from that of the frame 11.

Further, a deflectable locking part 15 for temporarily locking the movable housing 13 within the frame 11 is provided in the frame 11 and the movable housing 13.

Then, the locking part 15 releases the temporarily locking of the movable housing 13 and is restored in a state in which fitting between the fitting part 7 and the movable housing 13 is completed.

Moreover, a periphery of the restored locking part 15 is covered with a protection part 17.

Further, the locking part 15 has a first locking part 19 provided in the movable housing 13 and a second locking part 21 provided in the frame 11.

Moreover, when the fitting part 7 and the movable housing 13 are fitted together, the first locking part 19 is deflected by abutment on the fitting part 7, locks to a first engaged part 23 provided in the frame 11, and causes the movable housing 13 to be held within the frame 11.

Further, when the fitting part 7 and the movable housing 13 are fitted together, the second locking part 21 is deflected by abutment on a releasing part 25 provided on the one connector housing 3 and releases the temporary locking of the movable housing 13.

Moreover, the plural movable housings 13 are arranged in the frame 11, and timings for the plural movable housings 13, 13 to complete the respective fittings with the fitting parts 7 are different from each other.

As shown in FIGS. 1 to 12, the connector housing 3 that is one of the pair of the connector housings 3, 5 is made of an insulating material such as synthetic resin, and is provided with the plural (here, three) fitting parts 7, which are to be fitted with the fitted parts 9 of the other connector housing 5, on one side face thereof.

A plurality of terminals (not illustrated) is inserted from a plurality of openings provided on another side surface of the one connector housing 3 and is received and arranged within each of the plurality of fitting parts 7. It should be noted that each of the plurality of terminals is electrically connected by crimping or the like to a terminal part of an electric wire (not illustrated) connected to a power supply, an apparatus, or the like.

By moving this one connector housing 3 with the plurality of fitting parts 7 facing the other connector housing 5, the plurality of fitting parts 7 and the fitted parts 9 of the other connector housing 5 are fitted together.

The other connector housing 5 is attached to an attachment hole 29 of a pillar 27 as a static system member that is arranged in a vehicle via a temporary lock part 31 that is flexurally provided, so that the other connector housing 5 on a side of openings which are positioned on one side face of the fitted parts 9 is exposed from the attachment hole 29 of the pillar 27.

With these fitted parts 9, the fitting parts 7 of the one connector housing 3 are fitted. Such fitted parts 9 have the frame 11 and the plural (here, two) movable housings 13.

Incidentally, a lock part engaging portion 33 is formed on a top face of the fitting part 7 of the one connector housing 3, a lock part 35 is flexurally provided on a top face of the fitted part 9 of the other connector housing 5, and the lock part engaging portion 33 and the lock part 35 are engaged with each other, whereby the fitting state of the pair of the connector housings 3, 5 is retained.

The frame 11 is made of an insulating material such as synthetic resin, and is formed in a casing shape to be partitioned into plural (here, three) receiving chambers 37. In a bottom part of the receiving chamber 37 that is positioned in a center of the plural receiving chambers 37, a plurality of mating terminals, which are to be connected to the plural terminals received in the one connector housing 3, are inserted from the plural openings that are provided on the other face so as to be received and arranged.

It should be noted that each of the plurality of mating terminals is electrically connected by crimping or the like to a terminal part of an electric wire (not illustrated) connected to a power supply, an apparatus, or the like.

Into the receiving chambers 37, 37 that are positioned on both sides among the plural receiving chambers 37, the movable housings 13, 13 are inserted respectively from the openings on the other side face of the frame 11, whereby the movable housings 13, 13 are received and arranged movably in the fitting direction with the one connector housing 3 in the frame 11.

The movable housings 13, 13 are made of an insulating material such as synthetic resin, and are received and arranged respectively in the receiving chambers 37, 37 that are positioned on the both sides of the frame 11. In bottom parts of these movable housings 13, the plurality of mating terminals are inserted respectively from plural openings that are provided on the other face so as to be received and arranged, similarly to the receiving chamber 37 that is positioned in the center of the frame 11.

Within the receiving chambers 37, 37 of the frame 11, a temporary locking state of such movable housings 13, 13 within the frame 11 is held by the locking part 15 in a period from a state in which the movable housings 13, 13 are arranged within the frame 11 to a state in which fitting between the movable housings 13, 13 and the fitting parts 7 of the one connector housing 3 is completed.

The locking part 15 has the first locking parts 19, 19 respectively provided in the movable housings 13, 13 and the second locking parts 21, 21 provided in the receiving chambers 37, 37 located on both sides of the frame 11.

It should be noted that the first locking parts 19, 19 of the movable housings 13, 13 and the second locking parts 21, 21 of the frame 11 have the same configuration and only have different timing to release the temporary locking. Accordingly, the first locking part 19 of the one movable housing 13 and the one second locking part 21 of the frame 11 will be described below.

The first locking part 19 is provided on each side surface of the movable housing 13. Moreover, the first locking part 19 is formed of a pair of deflectable elastic pieces where a front in a fitting direction of the one connector housing 3 serves as a base end and a rear in the fitting direction thereof serves as a free end. Moreover, a first engaging part 39 formed in a hook shape is provided toward the free end of the first locking part 19.

When the fitting part 7 of the one connector housing 3 is inserted through openings of the frame 11 and the movable housing 13, this first locking part 19 is abutted on a displacement projection 41 projected on each side surface of the fitting part 7 and is deflected outward of the movable housing 13.

At this time, the first engaged part 23 formed by a step is provided on each side wall of the receiving chamber 37 of the frame 11 located outward of the first locking part 19, and the first engaging part 39 of the first locking part 19 deflected outward engages with the first engaged part 23.

By this engagement between the first engaging part 39 of the first locking part 19 and the first engaged part 23, the movable housing 13 is not moved within the frame 11, and a temporary locking position of the movable housing 13 to the frame 11 can be held.

Moreover, in a state in which the fitting of the fitting part 7 of the one connector housing 3 and the movable housing 13 is completed, the abutment between the displacement projection 41 of the fitting part 7 and the first locking part 19 is finished, the first locking part 19 is restored to an initial position, and the engagement between the first engaging part 39 and the first engaged part 23 is released.

In this way, the first locking part 19 is restored to the initial position in the state in which the fitting between the fitting part 7 of the one connector housing 3 and the movable housing 13 is completed. Accordingly, occurrence of permanent deformation of the first locking part 19 can be prevented.

In such timing of engagement of the first locking part 19, the engagement is started when the temporary locking of the movable housing 13 by the second locking part 21 is released, and the engagement is released when the fitting part 7 and the movable housing 13 are completely fitted together.

The second locking part 21 is provided in an upper part within the receiving chamber 37 of the frame 11. Moreover, the second locking part 21 is formed of a pair of deflectable elastic pieces where a front in the fitting direction of the one connector housing 3 serves as a base end and a rear in the fitting direction thereof serves as a free end. Moreover, a second engaging part 43 having an inclined surface is provided toward the free end of the second locking part 21.

A sliding part (not illustrated) having an inclined surface for sliding with the releasing part 25 provided in the one connector housing 3 is provided on a side of this second engaging part 43.

By inserting the movable housing 13 into the receiving chamber 37 of the frame 11, the second engaging part 43 of this second locking part 21 is abutted on a second engaged part 45 having an inclined surface provided on an upper surface of the movable housing 13.

By further inserting the movable housing 13 into the receiving chamber 37 of the frame 11 from this state, the second engaging part 43 slides along the inclined surface of the second engaged part 45, and the second locking part 21 is deflected upward. Then, the second locking part 21 is restored by climbing over the inclined surface of the second engaged part 45, and the second engaging part 43 is engaged with a back surface of the second engaged part 45.

By this engagement between the second engaging part 43 of the second locking part 21 and the second engaged part 45, coming off of the movable housing 13 from an inside of the receiving chamber 37 of the frame 11 is prevented, and the movable housing 13 is temporarily locked to the frame 11. This temporary locking state of the movable housing 13 is released by the releasing part 25 provided in the connector housing 3.

The releasing part 25 is formed on the top face of the fitting part 7 of the one connector housing 3 so as to be extended in the fitting direction of the pair of the connector housings 3, 5. This releasing part 25 is inserted into the receiving chamber 37 of the frame 11 by the fitting of the pair of the connector housings 3, 5, and slides along the inclined face of the sliding portion of the second locking part 21 so as to deflect the second locking part 21 upward.

By this deflection of the second locking part 21, the engagement between the second engaging part 43 of the second locking part 21 and the second engaged part 45 is released. In other words, the temporary locking state of the movable housing 13 to the frame 11 is released. The movable housing 13 is movable within the receiving chamber 37 of the frame 11 toward a front in the fitting direction of the one connector housing 3.

Moreover, when the first locking part 19 starts engagement, abutment between the releasing part 25 of the one connector housing 3 and the sliding part of the second locking part 21 is finished, the second locking part 21 is restored to an initial position, and the engagement between the second engaging part 43 of the second locking part 21 and the second engaged part 45 is released.

In this way, when the first locking part 19 starts the engagement, i.e. in the state in which the fitting between the fitting part 7 of the one connector housing 3 and the movable housing 13 is completed, the second locking part 21 has already been restored to the initial position. Accordingly, occurrence of permanent deformation of the second locking part 21 can be prevented.

In such timing of engagement or engagement release of the locking part 15, when the pair of connector housings 3, 5 is fitted together, first, the releasing part 25 of the one connector housing 3 deflects the second locking part 21 of the frame 11, and the engagement between the second engaging part 43 of the second locking part 21 and the second engaged part 45 of the movable housing 13 is released.

At this time, the displacement projection 41 of the fitting part 7 deflects the first locking part 19 of the movable housing 13, and the first engaging part 39 of the first locking part 19 and the first engaged part 23 of the frame 11 are engaged. By this engagement of the first locking part 19, even when the engagement of the second locking part 21 is released, the movable housing 13 can be held within the frame 11.

Then, when the fitting part 7 of the one connector housing 3 and the movable housing 13 are completely fitted together, the engagement of the first locking part 19 is released, and the movable housing 13 is movable within the frame 11.

By setting the engagement between the locking parts 15 as described above, the temporarily locking position of the movable housing 13 with respect to the frame 11 can be retained until the fitting part 7 and the movable housing 13 are fit with each other completely, so that the incomplete fitting state of the fitting part 7 and the movable housing 13 can be prevented.

The periphery of such a locking part 15 is covered with the protection part 17 in a restored state, i.e., a free state. Specifically, a periphery of the first locking part 19 is covered with a first protection part 47, and a periphery of the second locking part 21 is covered with a second protection part 49.

The first protection part 47 is provided on each side wall of the movable housing 13 and forms a cut-away recess so as to cover the periphery of the first locking part 19. This first protection part 47 covers the periphery of the first locking part 19 so that the first engaging part 39 of the first locking part 19 is not exposed from the side wall of the movable housing 13 in a state in which the first locking part 19 is restored, i.e., in a state in which the first locking part 19 is free.

In this way, since the first protection part 47 is provided on the periphery of the first locking part 19, the first locking part 19 does not greatly protrude outward from the movable housing 13 in the state in which the first locking part 19 is free, interference with a peripheral member can be prevented, and damage of the first locking part 19 can be prevented.

The second protection part 49 serves as a wall part on an upper surface that configures the receiving chamber 37 of the frame 11 and always covers the periphery of the second locking part 21. This second protection part 49 always covers the periphery of the second locking part 21 even in a state in which the second locking part 21 is deflected or restored, and the second locking part 21 is not exposed from the inside of the receiving chamber 37 to outside all the time.

In this way, since the second protection part 49 is provided on the periphery of the second locking part 21, the second locking part 21 is not exposed to an outside of the frame 11 even when the second locking part 21 is in any state, interference with a peripheral member can be prevented, and damage of the second locking part 21 can be prevented.

Timing to complete the fitting between the movable housings 13, 13 held within the frame 11 by the locking part 15 protected by such a protection part 17 and the fitting part 7 of the one connector housing 3 is set so as to be different between the one movable housing 13 and the other movable housing 13.

Figure 9:
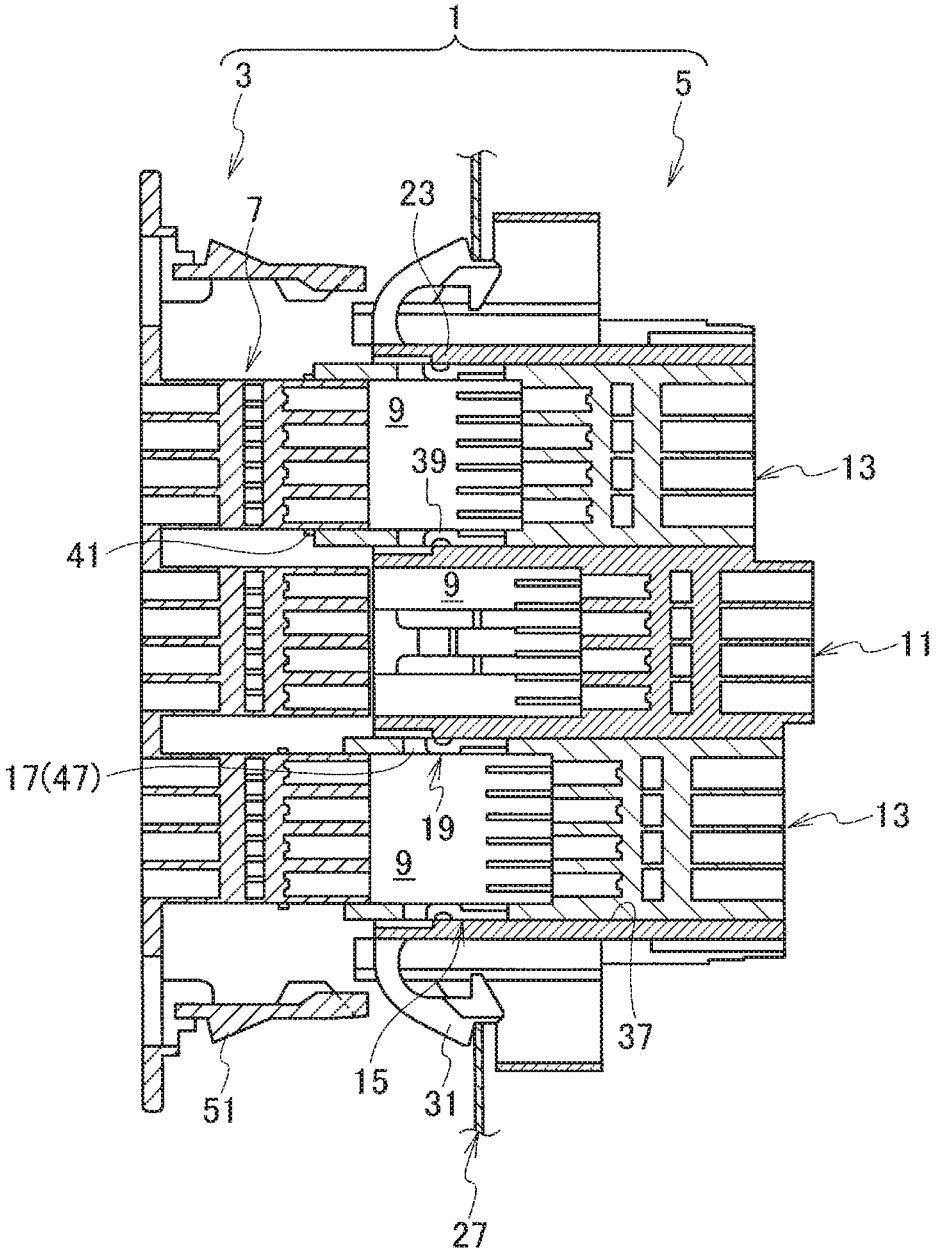
FIG. 9 is a sectional view when fitting of a pair of connector housings of the connector according to the embodiment of the present invention is started.

In detail, in the receiving chambers 37 of the frame 11, the one movable housing 13 (here, the upper-side movable housing in FIG. 9) is positioned more closely to the front side in the fitting direction than the other movable housing 13 (here, the lower-side movable housing in FIG. 9).

Therefore, if the pair of the connector housings 3, 5 are fit with each other, the one movable housing 13 firstly completes the fitting with the fitting part 7 of the one connector housing 3, and the other movable housing 13 subsequently completes the fitting with the fitting part 7 of the one connector housing 3.

Incidentally, since the frame 11 is fixed to the pillar 27 that is the static system member, the connector 1 is set to complete the fitting of the frame 11 and the fitting part 7 of the one connector housing 3 finally.

For the fitting of the pair of the connector housings 3, 5 in such a connector 1, the movable housings 13 are received in the receiving chamber 37 of the frame 11 as shown in FIG. 9 so that the one movable housing 13 may start fitting firstly; the other movable housing 13 may start fitting secondly; and the receiving chamber 37 which is positioned in the center of the frame 11 may start the fitting thirdly, whereby the fitting of the pair of the connector housings 3, 5 starts.

Figure 10:
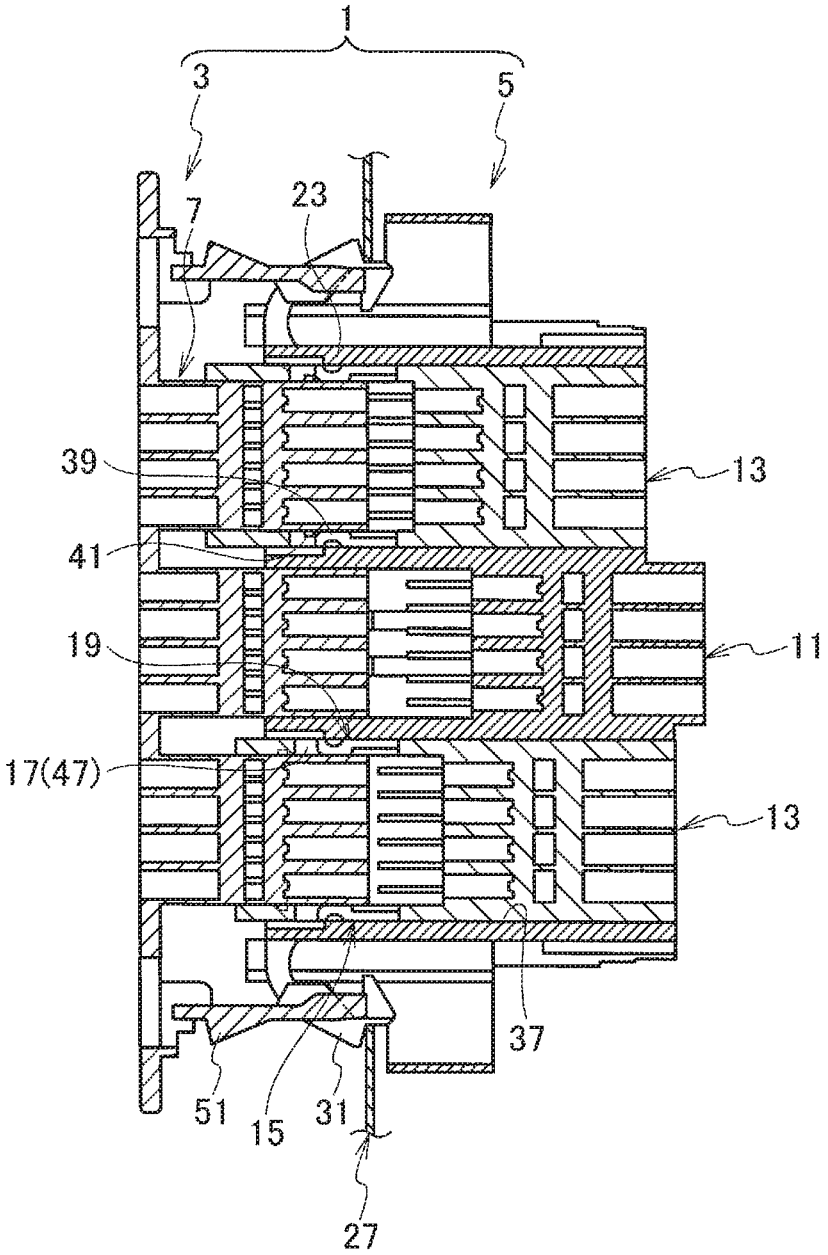
FIG. 10 is a sectional view when the pair of connector housings of the connector according to the embodiment of the present invention is in the middle of the fitting.

Next, as shown in FIG. 10, the fitting part 7 of the one connector housing 3 is further inserted into the fitted part 9 of the other connector housing 5, thereby starting the fitting of the fitting part 7 of the one connector housing 3 and the movable housings 13, 13.

At this time, in the one movable housing 13, the first locking part 19 abuts the displacement projection 41 of the fitting part 7 and starts the engagement between the first engaging part 39 and the first engaged part 23 by deflecting the first locking part 19 outward.

On the other hand, the releasing part 25 of the one connector housing 3 abuts the sliding part, and the second locking part 21 starts engagement release between the second engaging part 43 and the second engaged part 45 by deflecting the second locking part 21 upward.

Figure 11:
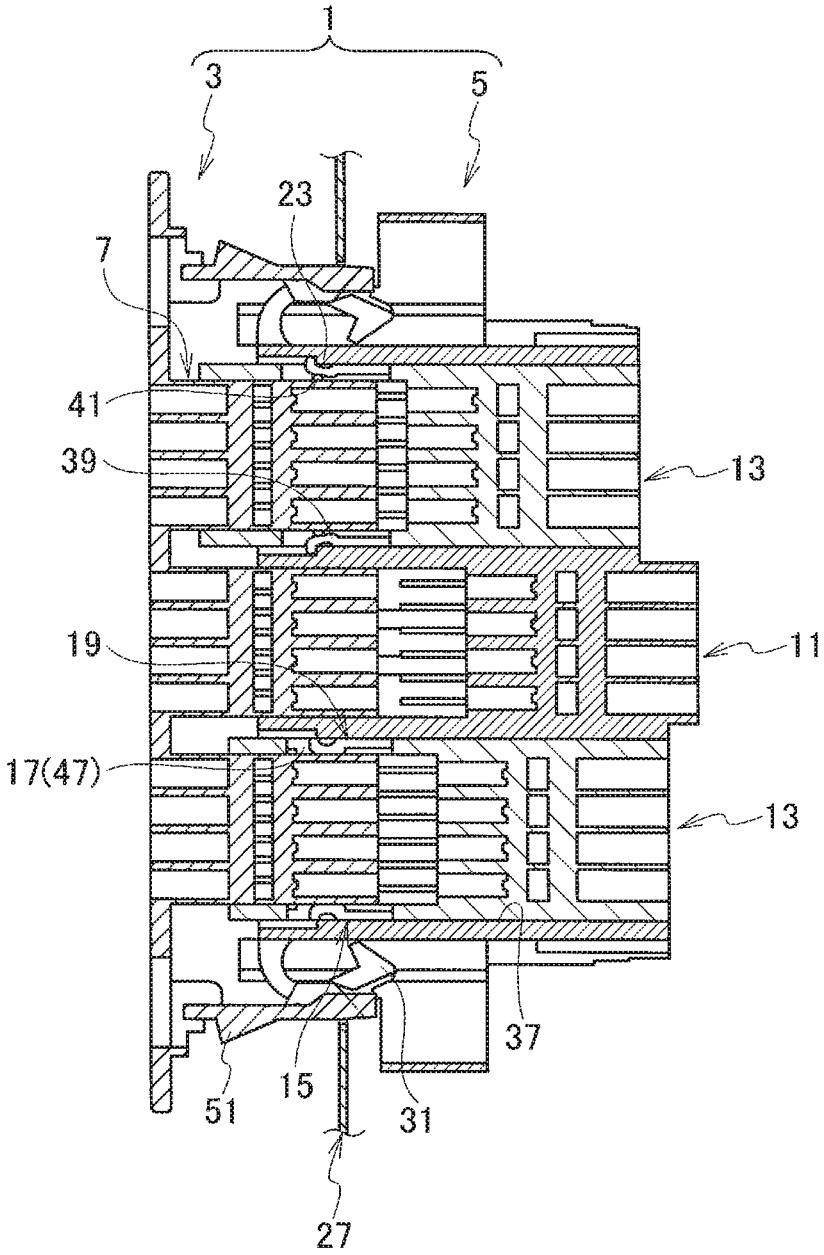
FIG. 11 is a sectional view when the pair of connector housings of the connector according to the embodiment of the present invention is in the middle of the fitting.

Next, as illustrated in FIG. 11, the fitting part 7 of the one connector housing 3 is further inserted into the fitted part 9 of the other connector housing 5, and fitting between the fitting part 7 of the one connector housing 3 and the movable housings 13, 13 is further advanced.

At this time, in the one movable housing 13, the first locking part 19 is completely deflected outward by the displacement projection 41 of the fitting part 7, and the first engaging part 39 and the first engaged part 23 are engaged.

On the other hand, the engagement between the second engaging part 43 and the second engaged part 45 is completely released, the abutment between the releasing part 25 of the one connector housing 3 and the sliding part is finished, and the second locking part 21 is restored to the initial position.

Next, although it is not illustrated, the fitting part 7 of the one connector housing 3 is further inserted into the fitted part 9 of the other connector housing 5, fitting between the fitting part 7 of the one connector housing 3 and the one movable housings 13 is completed, and fitting between the fitting part 7 of the one connector housing 3 and the other movable housing 13 is further advanced.

At this time, in the one movable housing 13, the first locking part 19 finishes abutment on the displacement projection 41 of the fitting part 7 and is restored to the initial position. The engagement between the first engaging part 39 and the first engaged part 23 is completely released.

By this engagement release of the first locking part 19, the temporary locking of the one movable housing 13 to the frame 11 is released, and the one movable housing 13 is moved in the fitting direction of the one connector housing 3 and does not hinder insertion of the one connector housing 3.

It should be noted that since operation of the locking part 15 similar to that of the one movable housing 13 is performed in the other movable housing 13 by further advancing the fitting between the pair of connector housings 3, 5, description thereof will be omitted.

Figure 12:
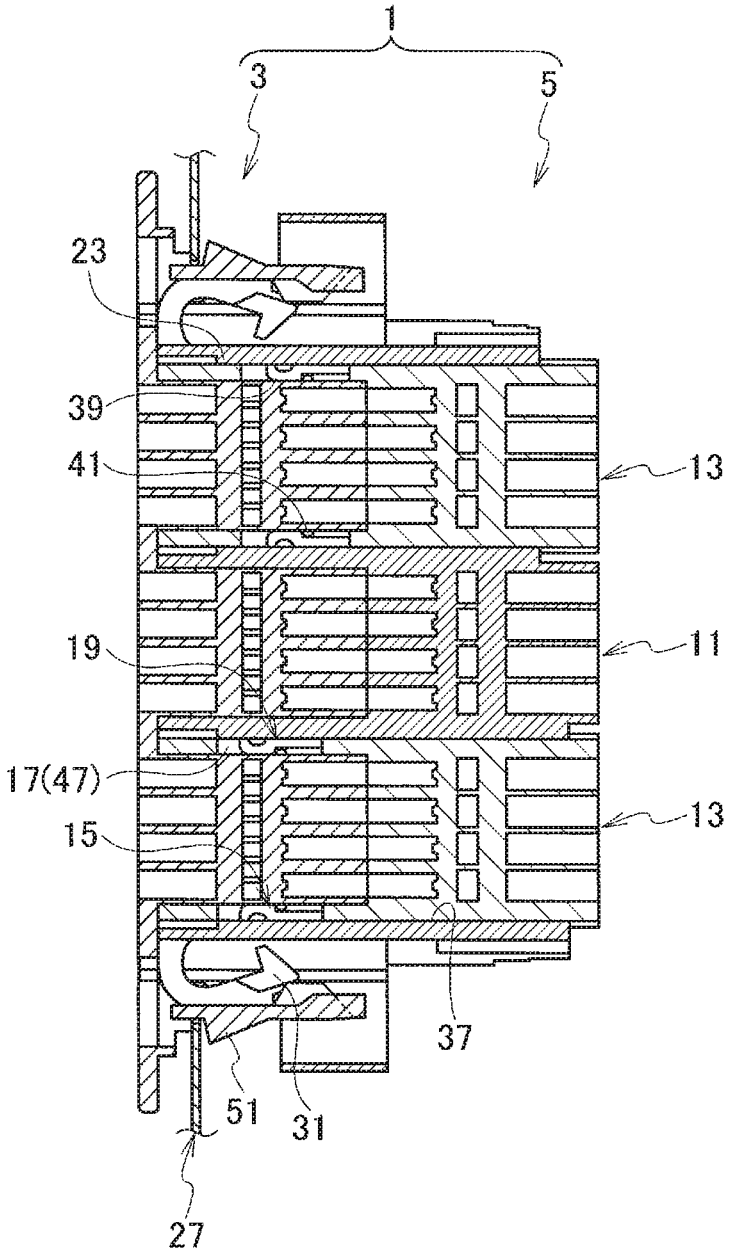
FIG. 12 is a sectional view when the fitting of the pair of connector housings of the connector according to the embodiment of the present invention is completed.

Finally, as illustrated in FIG. 12, the fitting part 7 of the one connector housing 3 is further inserted into the fitted part 9 of the other connector housing 5, the fitting part 7 of the one connector housing 3 and the receiving chamber 37 located at a center of the frame 11 are fitted together, and fitting of the pair of connector housings 3, 5 is completed.

Incidentally, in the state of completing the fitting of the pair of the connector housings 3, 5, the lock part engaging portion 33 of the one connector housing 3 and the lock part 35 of the other connector housing 5 are engaged with each other, thereby retaining the fitting state.

Besides, the pair of the connector housings 3, 5, after the completion of the fitting, releases the engagement between the temporary lock part 31 of the other connector housing 5 and the attachment hole 29 of the pillar 27. Then, a regular lock part 51 that is flexurally provided to the one connector housing 3 is engaged with the attachment hole 29 of the pillar 27, thereby retaining assembly with respect to the pillar 27.

As described above, the timings are different from each other in completing the fitting of: the fitting parts 7 of the one connector housing 3; with the frame 11 and the movable housings 13, 13 that constitute the fitted part 9 of the other connector housing 5, whereby a peak of an inserting force during the fitting of the pair of the connector housings 3, 5 can be dispersed. Thereby, fitting workability of the pair of connector housings 3, 5 can be enhanced.

In such a connector 1, the locking part 15 is restored by releasing the temporary locking of the movable housing 13 in a state in which the fitting between the fitting part 7 and the movable housing 13 is completed. In other words, the fitting of the movable housing 13 is not completed in a state in which the locking part 15 that has released the temporary locking of the movable housing 13 is deflected.

Accordingly, since the locking part 15 is not held in a deflected manner in a state in which the fitting of the movable housing 13 is completed, permanent deformation of the locking part 15 can be prevented.

Further, since the periphery of the restored locking part 15 is covered with the protection part 17, the locking part 15 is not exposed to outside in a free state, interference with a peripheral member can be prevented, and damage of the locking part 15 can be prevented.

Therefore, in such a connector 1, permanent deformation or damage of the locking part 15 can be prevented, and temporary locking of the movable housing 13 can be performed stably.

Further, the first locking part 19 holds the movable housing 13 within the frame 11 when the fitting part 7 and the movable housing 13 are fitted together, and the second locking part 21 holds the movable housing 13 within the frame 11 before the fitting between the pair of connector housings 3, 5. Accordingly, the movable housing 13 can be temporarily locked within the frame 11 reliably until the fitting of the movable housing 13 is completed.

Further, since the timings for the plural movable housings 13, 13 to complete the fitting with the fitting parts 7 are different from each other, the fitting force of the pair of the connector housings 3, 5 can be dispersed further, whereby the fitting workability of the pair of the connector housings 3, 5 can be enhanced.

Incidentally, in the connector according to the embodiment of the present invention, the other connector housing is fixed to the static system member such as the pillar, but is not limited to this, and either of the pair of the connector housings may be unfixed to the static system member.

Further, the locking part is provided in both of the frame and the movable housing. However, the present invention is not limited to this. The locking part may be provided in at least one of the two, and the locking part may be provided in only one of them.

Furthermore, the two movable housings are arranged in the frame, but the number of the movable housings is not limited to two, and the two or more movable housings may be arranged movably in the frame. In addition, the plural movable housings may be arranged not only in a width direction but in a height direction of the frame.

What is claimed is:

1. A connector comprising:

a pair of connector housings;

a fitting part provided in one connector housing of the pair of connector housings; and a fitted part provided in another connector housing of the pair of connector housings and to which the fitting part is fitted, wherein the fitted part has a frame and a movable housing, the movable housing is arranged within the frame so as to be movable in a fitting direction of the one connector housing, and timing to complete fitting between the movable housing and the fitting part is different from timing to complete fitting between the frame and the fitting part, a deflectable locking part configured to temporarily lock the movable housing within the frame is provided in at least any one of the frame and the movable housing, the locking part is restored by releasing the temporary locking of the movable housing in a state in which the fitting between the fitting part and the movable housing is completed, a periphery of the restored locking part is covered with a protection part, the locking part has a first locking part provided on the movable housing and a second locking part provided in the frame, when the fitting part and the movable housing are fitted together, the first locking part is deflected by abutment on the fitting part, is locked to a first engaged part provided in the frame, and causes the movable housing to be held within the frame, and when the fitting part and the movable housing are fitted together, the second locking part is deflected by abutment on a releasing part provided on the one connector housing and releases the temporary locking of the movable housing.

2. The connector according to claim 1, wherein a plurality of the movable housings are arranged in the frame, and timings for the plurality of the movable housings to complete fitting with the fitting parts are different from each other.

3. The connector according to claim 1, wherein the movable housing comprises a first movable housing and a second movable housing that are movable within the frame, and the first movable housing and the second movable housing are temporarily locked by the locking part at different positions in the fitting direction within the frame, such that timings for the first and second movable housings to complete fitting with the fitting parts are different from each other.

4. The connector according to claim 1, wherein the deflectable locking part temporarily locks the movable housing within the frame until the fitting between the fitting part and the movable housing is completed.

5. The connector according to claim 1, wherein the locking part includes a first locking part and a second locking part, such that the second locking part temporarily locks the movable housing within the frame, and the first locking part temporarily locks the movable housing within the frame when the second locking part is deflected to release the temporary lock of the movable housing, and when the first and second locking parts release the temporary lock of the movable housing, the movable housing is completely fitted to the fitting part such that the movable housing become movable within the frame.

6. The connector according to claim 1, further comprising a lock part and a lock part engaging portion that lock the one connector housing to said another connector housing when the fitting of the pair of the connector housings is completed.

7. The connector according to claim 1, wherein the fitting of the movable housing to the fitting part is not completed in a state where the locking part that has released the temporary locking of the movable housing is deflected.

* * * * *